US006205978B1

(12) United States Patent
Zoeller

(10) Patent No.: US 6,205,978 B1
(45) Date of Patent: Mar. 27, 2001

(54) FUEL INJECTION

(75) Inventor: Herbert Zoeller, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/272,376

(22) Filed: Mar. 19, 1999

(30) Foreign Application Priority Data

Mar. 19, 1998 (DE) ..... 198 12 170

(51) Int. Cl.[7] ..... F02M 37/04
(52) U.S. Cl. ..... 123/456; 123/467
(58) Field of Search ..... 123/456, 467, 123/501, 500, 447, 458

(56) References Cited

U.S. PATENT DOCUMENTS 4,627,403 12/1986 Matsumura .
5,823,161 10/1998 Potz et al. .

FOREIGN PATENT DOCUMENTS 1576330 4/1970 (DE) .
34 11 539 A1 10/1985 (DE) .
0 686 764 A2 12/1995 (DE) .
2 215 776 9/1989 (GB) .

OTHER PUBLICATIONS

MTZ Motortechnische Zeitschrift 58 (1997) 10.

*Primary Examiner*—Carl S. Miller
(74) *Attorney, Agent, or Firm*—Evenson, McKeown, Edwards & Lenahan, P.L.L.C.

(57) ABSTRACT

In a fuel injection system for a multi-cylinder internal combustion engine with a cam-controlled high-pressure injection pump for transporting the fuel to a common fuel line (common rail), which acts as high-pressure storage and from which injection lines lead to injection nozzles and which possesses a solenoid valve control that determines the start of the feeding of the fuel, in every exposed fuel line which is an injection line between the common fuel line and an injection nozzle, a solenoid valve which controls the starting point for feeding fuel to the engine is arranged in close proximity to the common fuel line.

7 Claims, 2 Drawing Sheets

FUEL INJECTION

BACKGROUND AND SUMMARY OF THE INVENTION

This application claims the priority of German application No. 198 12 170.9, filed Mar. 19, 1998, the disclosure of which is expressly incorporated by reference herein.

The invention relates to a fuel injection system for a multi-cylinder internal combustion engine with a cam-controlled high-pressure injection pump for transporting fuel to a common fuel line (common rail), which acts as a high-pressure storage system from which injection lines lead to injection nozzles, and which possesses a solenoid valve control that determines the respective initial point for feeding fuel to the engine.

Such a fuel injection system is disclosed in MTZ *Motortechnische Zeitschrift* 58 (1997) 10. In this system, costly injectors are used, each of which possesses an injection nozzle, a piston valve, as well as a solenoid valve. In this design, the high fuel pressure acts upon the common fuel line and in the injection lines, and also concurrently acts directly on the pressure absorption area of the injection nozzle and the larger absorption area of the piston valve which delimits a control space through which the injector needle is pressed onto its seat. After the solenoid valve is opened, a decrease of pressure is created at the piston valve, which in turn causes the injector nozzle to open. For completion of the injection process, the solenoid valve is closed, the entire gas pressure once again acts upon the piston valve and the injection nozzle closes again.

If the fuel, which is queued at the injector nozzle or at the injector needle, is injected into the combustion chamber at the beginning of the injection process and under extremely high pressure, then at the time of the beginning of the ignition, the pressure, temperature and also the $NO_x$ formation in the combustion chamber rise very steeply. In order to achieve a nominal $NO_x$ limit, the beginning of the injection has to be shifted in the direction of "late". As a result of this shift, the injected fuel cannot be used efficiently.

It is therefore an object of the invention to provide a fuel injection system, in which a large increase of the fuel pressure at the beginning of the injection process is reduced.

Another objective of the invention is to reduce combustion noise.

These and other objects and advantages are achieved by the fuel injection system according to the present invention, in which the solenoid valve is shifted into close proximity of the area of the common fuel line. As a result, costly injectors can be dispensed with and only one standard injection nozzle is used. Thus, in the simplest manner, a fuel injection system is created in which the increase of the fuel pressure in the exposed injection line at the start of the feeding of fuel to the engine can be delayed due to the long distance between the solenoid valve and the needle seat of the injection nozzle. That is, because of this long distance, with its correspondingly large dead volume, the ignition is delayed, and neither the pressure nor the temperature rise as steeply. While using the same starting point for feeding the fuel to the engine, distinctly less $NO_x$ is produced.

Because the $NO_x$ values are well below the nominal limit, the starting point for feeding fuel to the engine can be greatly advanced (shifted in the direction of "early") until the $NO_x$ values again reach the same limit. However, as a consequence of the earlier starting point for feeding fuel to the engine, the fuel is used more efficiently, which has the benefit of reducing the specific fuel consumption.

Other objects, advantages and novel features of the present invention will become apparent from the following detailed description of the invention when considered in conjunction with the accompanying drawings.

DETAILED DESCRIPTION OF THE DRAWINGS

Figure 1:
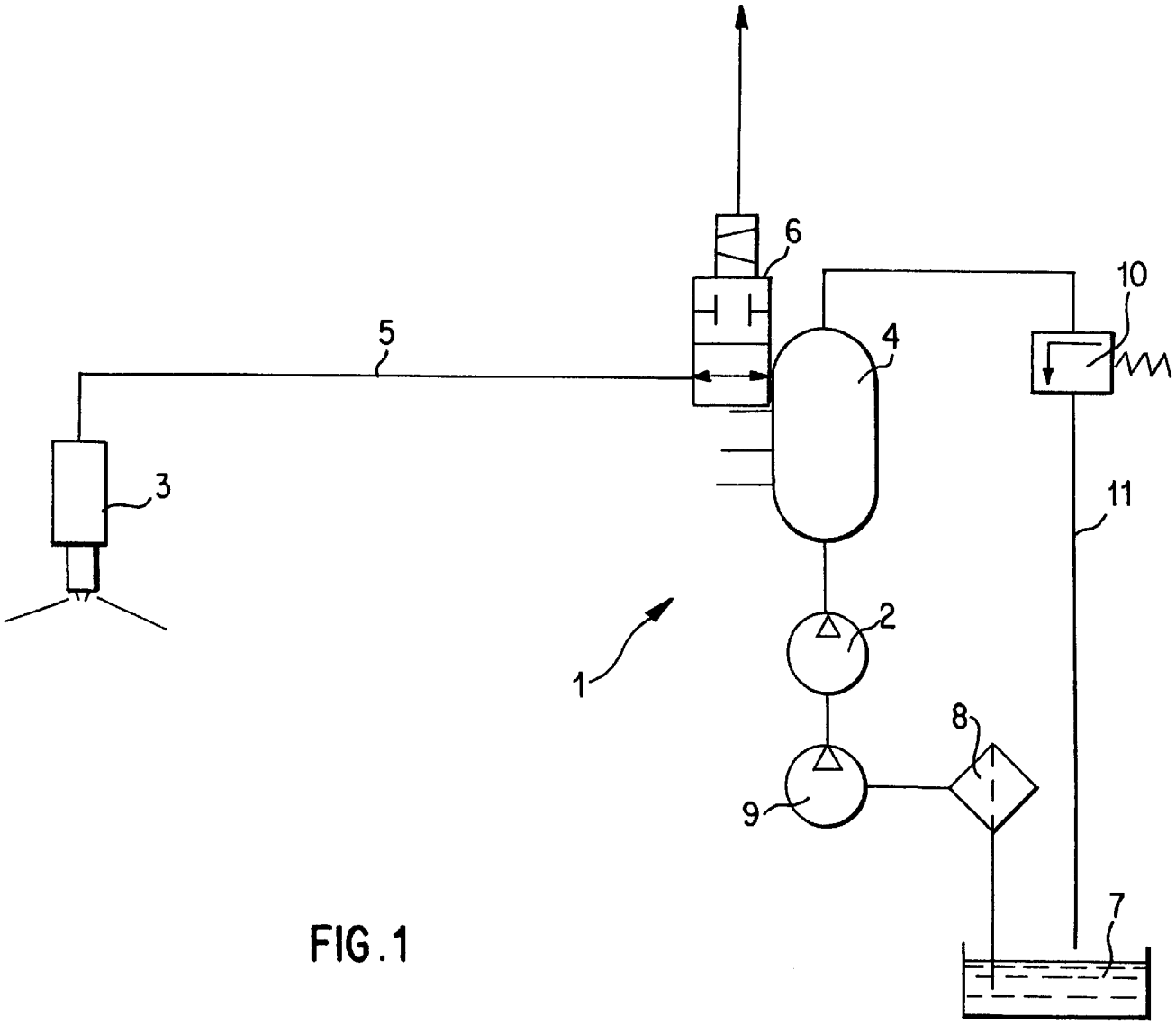
FIG. 1 shows a fuel injection system in accordance with the definition of the invention.

A fuel injection system for multi-cylinder internal combustion engines, in accordance with FIG. 1, consists mainly of a high-pressure injection pump 2, which transports the fuel into a common fuel line 4 (the so-called common rail) which is provided for all injection nozzles 3. The fuel line 4 acts as a high-pressure storage, in which the injection pressure is held at a constant level of up to 1350 bar.

The common fuel line 4 is connected to the respective injection nozzles 3 via exposed or external injection lines 5. The injection nozzles 3 are standard, single-acting nozzles, eliminating the need for costly injectors with piston valves, control space and internal line branching leading to the control space, with an integrated, rapid-shift solenoid valve for controlling the connection between the control space and the unloading system and (at the same time) for controlling the injector needle, which is lifted off its needle seat during the pressure reduction in the control space.

Control of the moment of injection and amount of fuel is handled by a rapid-shift solenoid valve 6, which is a 2/2 directional control valve and is placed at a specific place in the injection line (namely directly attached to the common fuel line 4) in order to attain a meaningful route segment for a defined dead volume between this solenoid valve 6 and the injection nozzle 3 for the delay or respectively the displacement of the combustion. As a result, the increase of the fuel pressure is reduced in the injection line 5 in front of the injection nozzle 3. The combustion noise level is thus correspondingly lowered, as well as the $NO_x$ values (despite the same starting point for feeding the fuel).

The starting point for feeding the fuel can thus easily be advanced until the same $NO_x$ limit is reached once again. The advancement in the direction of "early" (starting from ZOT) can range from 2° to 9°. The advantage of this measure is that it more efficiently uses the fuel (while using the same quantity of fuel). Therefore, not only a reduction of the combustion noise is attained but also a decrease of the specific fuel consumption.

Shown in FIG. 1 is a gasoline tank 7, a filter 8, a pre-feed pump 9 and an overflow valve 10, which is installed in a recirculation line 11 which branches off from the fuel line 4 and is connected to the gasoline tank 7.

Figure 2:
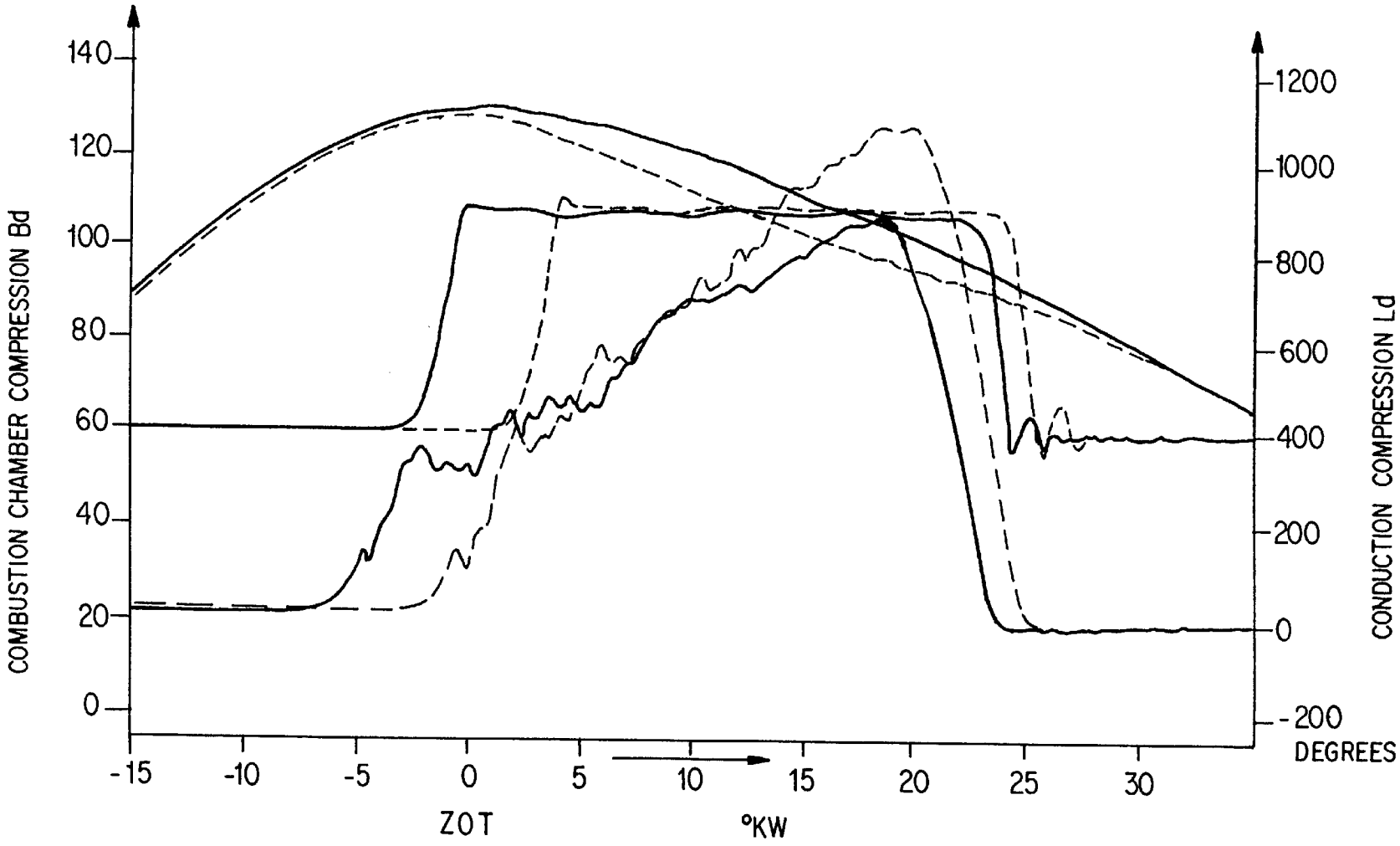
FIG. 2 shows a plot of the line pressure and the combustion chamber pressure as well as the needle stroke as a function of the degree of the crank angle, for the invention and for the prior art.

In FIG. 2, a diagram depicts the line pressure plot and the cylinder or respectively the combustion chamber pressure plot via the degree of the crank angle. The broken lines denote the respective state-of-the-art technology and the solid lines depict the respective plots according to the fuel system of the present invention. In the state-of-the-art technology, feeding of fuel to the engine starts at approximately 2° before ZOT. As a result, a steep rise in the line pressure Ld occurs, with the maximum pressure value reaching approximately 900 bar. The combustion chamber pressure Bd reaches a peak value of approximately 130 bar in the area of ZOT, and then suddenly falls off again.

In contrast, in the fuel system according to the invention, feeding of fuel to the engine begins at a crank angle of approximately 7° before ZOT. The steep rise of the line pressure Ld is reduced significantly (here) in the area of approximately 300 bar of line pressure and remains constant at this point. Thus, it results in a step which covers a crank angle area of approximately 2° before ZOT. The peak value of the line pressure Ld by comparison is much higher, namely at approximately 130 bar. The combustion chamber pressure also reaches a peak value of about 1100 bar, but falls off significantly later. This means that a significantly more efficient use of the fuel can be made. In the diagram shown in FIG. 2, the respective needle stroke is designated with Nh.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Fuel injection system for a multi-cylinder internal combustion engine, comprising:

a high pressure storage element in the form of a common fuel line;

a high-pressure injection pump for transporting fuel to the common fuel line;

a plurality of infection nozzles;

a plurality of injection lines connecting the common fuel line with the injection nozzles; and a solenoid valve for controlling feeding of high pressure fuel from said common fuel line to said injection nozzles via said injection lines, and determining a respective initial point for each such feeding of fuel, wherein the solenoid valve is attached to the common fuel line and interrupts fuel flow in said injection lines at a point immediately adjacent said common fuel line, to control the initial point for feeding the fuel to the engine via a dead volume comprising substantially an entire length of each injection line; and the injection nozzles are single-acting nozzles.

2. The fuel injection system according to claim 1, wherein the high-pressure injection pump is a cam-controlled high-pressure injection pump.

3. The fuel injection system according to claim 1, wherein the solenoid valve is a 2/2 directional control valve in every injection line.

4. The fuel injection system according to claim 1, wherein peak pressure for a respective load range includes a step function in an area of ZOT and a predominantly constant line pressure.

5. The fuel injection system according to claim 3, wherein peak pressure for a respective load range includes a step function in an area of ZOT and a predominantly constant line pressure.

6. Fuel injection system according to claim 1, wherein feeding of fuel to the engine is advanced beginning from approximately ZOT.

7. Fuel injection system according to claim 6, wherein an initial point for feeding fuel to the engine is advanced in an early direction within a range of 2° to 9° of a crank angle degree.

* * * * *